US006073823A

United States Patent [19]

Gordon

[11] Patent Number: 6,073,823

[45] Date of Patent: Jun. 13, 2000

[54] MULTI-PURPOSE UTILITY BELT

[76] Inventor: Glenn Gordon, 2625 Piedmont Rd., Suite 56-373, Atlanta, Ga. 30324

[21] Appl. No.: 09/158,384

[22] Filed: Sep. 22, 1998

[51] Int. Cl.[7] ..... A45F 5/00

[52] U.S. Cl. ..... 224/661; 224/665; 224/684; 224/901.8; 224/933

[58] Field of Search ..... 224/660, 661, 224/663, 665, 682, 684, 251, 904, 907, 932, 933, 901.8, 148.6

[56] References Cited

U.S. PATENT DOCUMENTS

| | | | |
|---|---|---|---|
| D. 348,565 | 7/1994 | Cummins | 224/663 X |
| 4,220,302 | 9/1980 | Hampton et al. | 224/901.8 X |
| 4,403,366 | 9/1983 | Lucke | 224/901.8 X |
| 4,625,862 | 12/1986 | Clayton | 224/932 X |
| 4,848,624 | 7/1989 | Clem | 224/661 X |
| 4,852,782 | 8/1989 | Wu et al. | 224/661 |
| 4,957,232 | 9/1990 | Sprague | 224/932 X |
| 4,986,459 | 1/1991 | Yarbrough, Jr. | 224/932 X |
| 5,004,136 | 4/1991 | Leath | 224/932 X |
| 5,240,156 | 8/1993 | Sicotte et al. | 224/901.8 X |
| 5,385,281 | 1/1995 | Byrd . | |
| 5,441,185 | 8/1995 | Dragos | 224/932 X |
| 5,489,051 | 2/1996 | Robinson . | |
| 5,505,356 | 4/1996 | Noriega et al. | 224/682 X |
| 5,568,889 | 10/1996 | Holloway, Jr. et al. . | |
| 5,573,153 | 11/1996 | Stillman | 224/148.6 |
| 5,626,272 | 5/1997 | Klemansky . | |
| 5,664,712 | 9/1997 | Smrt | 224/904 X |
| 5,693,006 | 12/1997 | Slautterback . | |
| 5,695,104 | 12/1997 | Darling . | |

*Primary Examiner*—Gregory M. Vidovich
*Attorney, Agent, or Firm*—Kenneth L Tolar

[57] ABSTRACT

A multi-purpose utility belt includes an elongated planar strap having first and second ends with an attachment means adjacent each end thereof for securing the strap about a user's abdomen. Depending from the lower edge of the strap is a panel having a hook-and-loop fastener adjacent each of its four peripheral edges. A wiping cloth having similarly disposed hook-and-loop fasteners on a side thereof is removably attachable to the panel. A plurality of tool holding pockets are removably attached to the exterior surface of the strap allowing a user to selectively configure the belt. Each pocket is designed to retain a select tool such as a paint brush, a caulking gun and similar items.

8 Claims, 1 Drawing Sheet

MULTI-PURPOSE UTILITY BELT

BACKGROUND OF THE INVENTION

The present invention relates to a multi-purpose belt designed for painters, caulkers, mechanics and similar workers having a means for retaining a wipe cloth and similar accessories thereon.

DESCRIPTION OF THE PRIOR ART

When painting, caulking, or performing similar tasks, a worker often needs a wipe cloth to remove grease, paint, or caulk from the user's hands. Often, the worker must store a rag within a trouser pocket resulting in needlessly soiled clothing. Furthermore, when performing such tasks, the worker often interchangeably uses a variety of tools such as a paint brush, caulking guns, and sometimes even miscellaneous documents. Although various tool belts exist in the prior art, they typically include a number of various holders, only some of which are needed for a given task. The present invention provides a multi-purpose utility belt having a plurality of removable tool holders thereon each for retaining various tools or documents. Accordingly, the belt may be selectively configured for a given task. In addition, the belt includes a removable cloth for cleaning tools or wiping the user's hands eliminating the undesirable practice of carrying a rag in one's pocket.

Various tool holders and belts exist in the prior art. For example, U.S. Pat. No. 5,695,104 issued to Darling relates to a painter's accessory holder including a caulking gun bracket attached to the base member configured to accept a caulking gun. The device also includes a sandpaper bracket and U-shaped tool bracket.

U.S. Pat. No. 5,693,066 issued to Slautterback relates to a method of using a lifting belt in combination with an accessory base.

U.S. Pat. No. 5,568,889 issued to Holloway, Jr. et al relates to a foldable tool holder including an L-shaped support having five pockets thereon each for holding various objects.

U.S. Pat. No. 5,626,272 issued to Klemansky relates to a drywall device including a tub having side walls, end walls, a bottom, a snap down top and a belt attachment.

U.S. Pat. No. 5,489,051 issued to Robinson relates to a painter's pouch including a hip supported, belt-attached base member which is attached by means of a separable ball and socket joint to a swinging, sealable paint container and fitted tool carrier.

U.S. Pat. No. 5,385,281 issued to Byrd relates to a painter's utility belt including a first loop which may be secured about a paint can to support the can from the belt and a second loop for securing a caulking gun.

Although various utility belts exist in the prior art, none have the unique features and advantages according to the present invention. The present invention includes a convenient wiping cloth retaining means eliminating the sloppy practice of carrying a rag in one's pocket. Furthermore, the belt includes a plurality of removable tool storage pouches allowing a user to selectively configure the belt to suit a particular application.

SUMMARY OF THE INVENTION

The present invention relates to a multi-purpose utility belt for retaining tools and similar items thereon. The device comprises an elongated, planar strap having first and second ends with a fastener means adjacent each end for securing the belt about a user's waist. Depending downwardly from the lower edge of the belt is a panel having a separable loop extending from opposing edges thereof for securing the panel to the wearer's leg. The exterior surface of the panel includes a hook and loop fastener adjacent each peripheral edge for retaining a wiping cloth thereon. The strap also includes a plurality of removable tool holding pockets thereon for retaining a paint brush, a caulking gun, documents and similar items. It is therefore an object of the present invention to provide a multi-purpose utility belt having a wiping cloth removably attached thereto.

It is yet another object of the present invention to provide a utility belt capable of storing a plurality of tools and similar items thereon.

It is yet another object of the present invention to provide a multi-purpose utility belt which can securely retain documents and similar items therein.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
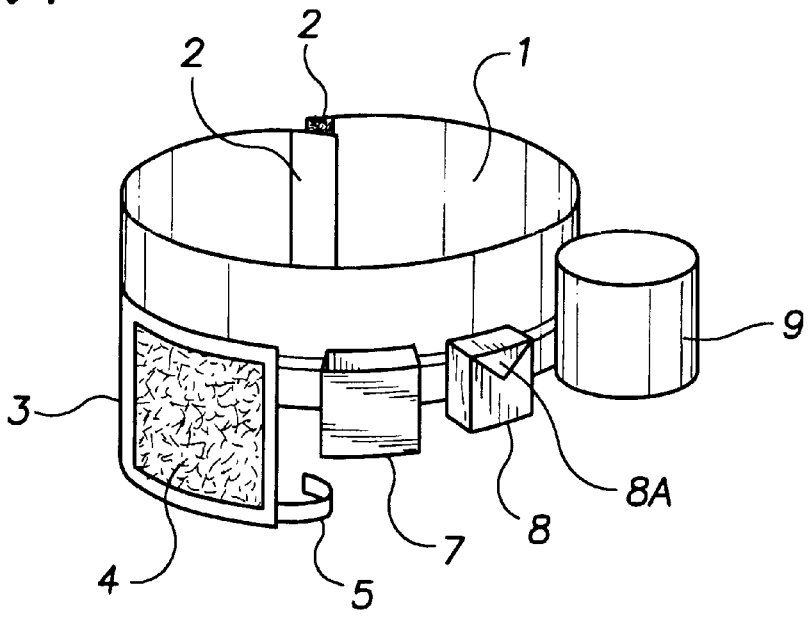
FIG. 1 is a perspective view of the inventive device.
Figure 2:
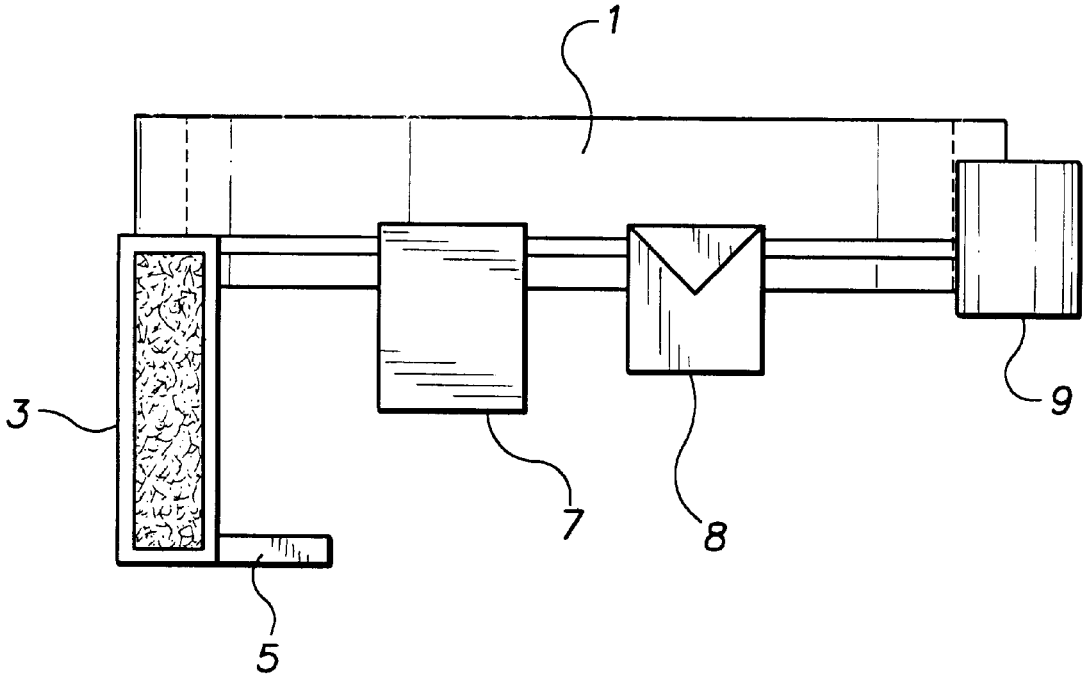
FIG. 2 is a side view of the inventive device.

Referring now to FIGS. 1 and 2, the present invention relates to a multi-purpose utility belt for retaining wiping cloths and various tools. The device comprises an elongated planar strap 1 having an inner surface, an outer surface, a bottom edge, a top edge and first and second ends with a fastener means 2 adjacent each end thereof for securing the belt member about a user's abdomen or waist. Preferably, the fastener means relates to a hook-and-loop fastener such as VELCRO®. However, any other similar attachment means may also be used such as buckles, snaps, etc. The strap is constructed with an expandable, elastomeric material and is significantly wider than a conventional belt to provide support to the user's back when placed thereabout.

Downwardly depending from the bottom edge of the strap is a substantially rectangular panel 3 having four peripheral edges, an inwardly facing side and an outwardly facing side. On the outwardly facing side of the panel adjacent each peripheral edge is a hook and loop fastener. A wiping cloth 4 having a substantially similar configuration as the panel includes a hook-and-loop fastener adjacent each peripheral edge allowing the cloth to be conveniently secured to the panel.

Extending from two opposing edges of the panel is a separable loop 5 for further securing the panel to a user's leg. The separable loop is joined about the user's leg with hook-and-loop fasteners or any other conventional fastener.

Disposed on the outer surface of the strap are a plurality removable pockets for retaining tools and similar items therein. The pockets are preferably secured with hook and loop fasteners although any other suitable, conventional attachment means may be used. The removable pockets allow a user to selectively configure the belt to include any combination of pockets depending upon the application. A first pocket 7 has a substantially rectangular cross-sectional configuration and is dimensioned to receive a tool such as a paint brush. A second, box-type pocket 8 includes a closure means 8A thereon for securely retaining indispensable or perishable items such as documents. A removable sleeve is cylindrical having two opposing open ends and is dimensioned to retain a caulking gun or similar tool.

The strap according to the present invention is preferably manufactured with nylon fabric while the wiping cloths are manufactured with terrycloth or a similar moisture absorbing material. The panel may be constructed with leather, vinyl or a similar equivalent. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A multi-purpose tool belt comprising:

an elongated strap having first and second ends, an outer surface and a lower edge, each of said ends having an attachment means adjacent thereto for selectively joining said strap about a user's torso;

a plurality of pockets removably attached to said belt, each configured to receive a select accessory item therein;

a panel depending from the lower edge of said strap, said panel having an outer surface, an inner surface and a lower edge, said panel having a peripheral fastener means disposed on the outer surface thereof;

a wiping cloth sheet having substantially similar dimensions and configuration as said panel, said sheet further having a fastener means on a side thereof for selectively engaging said peripheral fastener means on said panel such that said sheet substantially covers said panel.

2. A tool belt according to claim 1 wherein said panel further includes a pair of side edges each having a band attached thereto selectively wrapped about a user's leg and joined with the other of said bands to secure said panel to the user's leg.

3. A tool belt according to claim 2 wherein said attachment means is a hook-and-loop fastener.

4. A tool belt according to claim 3 wherein one of said pockets is configured and dimensioned to retain a paint brush therein.

5. A tool belt according to claim 4 wherein one of said pockets is enclosed for retaining indispensable and perishables therein.

6. A tool belt according to claim 1 further comprising an elongated cylindrical sleeve having a pair of opposing open ends for receiving and supporting an elongated tool, said sleeve removably secured to said strap with hook and loop fasteners.

7. A tool belt according to claim 6 wherein said strap is elastomeric and has a sufficient width to provide support to a wearer's back.

8. A tool belt according to claim 2 wherein said bands are joined with a hook-and-loop fastener.

* * * * *